US009067445B2

(12) United States Patent
Donaldson

(10) Patent No.: US 9,067,445 B2
(45) Date of Patent: Jun. 30, 2015

(54) SYSTEM AND METHOD OF PRINTHEAD CALIBRATION WITH REDUCED NUMBER OF ACTIVE INKJETS

(71) Applicant: Xerox Corporation, Norwalk, CT (US)

(72) Inventor: Patricia J. Donaldson, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 25 days.

(21) Appl. No.: 14/029,509

(22) Filed: Sep. 17, 2013

(65) Prior Publication Data

US 2015/0077454 A1 Mar. 19, 2015

(51) Int. Cl.
*B41J 29/393* (2006.01)

(52) U.S. Cl.
CPC ..... *B41J 29/393* (2013.01)

(58) Field of Classification Search
CPC .. B41J 2/04505; B41J 2/0451; B41J 2/04558; B41J 2/04573; B41J 11/008; B41J 11/42; B41J 11/46; B41J 25/001; B41J 29/38; B41J 29/393
USPC ..... 347/14, 15, 19
See application file for complete search history.

(56) References Cited

U.S. PATENT DOCUMENTS 5,343,231 A 8/1994 Suzuki
5,451,990 A 9/1995 Sorenson et al.
5,600,350 A 2/1997 Cobbs et al.
5,796,414 A 8/1998 Sievert et al.
6,076,915 A 6/2000 Gast et al.
6,089,693 A 7/2000 Drake et al.
6,196,652 B1 3/2001 Subirada et al.
6,213,580 B1 4/2001 Segerstrom et al.
6,275,600 B1 8/2001 Banker et al.
6,300,968 B1 10/2001 Kerxhalli et al.
6,334,720 B1 1/2002 Kato et al.
6,377,758 B1 4/2002 OuYang et al.
6,467,867 B1 10/2002 Worthington et al.
6,494,558 B1 12/2002 Doval et al.
6,554,390 B2 4/2003 Arquilevich et al.
6,637,853 B1 10/2003 Ahne et al.
6,847,465 B1 1/2005 Wetchler et al.
6,883,892 B2 4/2005 Sievert et al.
6,942,313 B2 9/2005 Kanda
6,993,275 B2 1/2006 Mitsuya et al.
7,073,883 B2 7/2006 Billow
7,118,188 B2 10/2006 Vilanova et al.
7,254,254 B2 8/2007 Ueda et al.
7,309,118 B2 12/2007 Mizes et al.
7,380,897 B2 6/2008 Anderson et al.
7,390,073 B2 6/2008 Bailey et al.
7,391,525 B2 6/2008 Chapman et al.

(Continued)

*Primary Examiner* — Geoffrey Mruk
*Assistant Examiner* — Scott A Richmond
(74) *Attorney, Agent, or Firm* — Maginot Moore & Beck LLP

(57) ABSTRACT

A method for printhead location identification includes identifying a plurality of amplitudes for a portion of pixel columns in image data generated from a portion of an image receiving surface in which marks formed by an inkjet in the printhead are printed. The amplitudes are generated from a portion of each pixel column including expected locations for a portion of the printed marks in a process direction. The method further includes identifying a cross-process location of the inkjet from a pixel column corresponding to a pixel column with a maximum local amplitude value and storing the location of the inkjet in a memory for printhead registration.

7 Claims, 9 Drawing Sheets

(56) References Cited

U.S. PATENT DOCUMENTS

| | | | | |
|---|---|---|---|---|
| 7,478,894 | B2 | 1/2009 | Kim et al. | |
| 7,515,305 | B2 | 4/2009 | Mizes | |
| 7,549,721 | B2 | 6/2009 | Nakano et al. | |
| 7,552,986 | B2 | 6/2009 | Mizes et al. | |
| 7,607,752 | B2 | 10/2009 | Childers et al. | |
| 7,630,653 | B2 | 12/2009 | Bonino | |
| 7,637,586 | B2 | 12/2009 | Yun | |
| 7,686,298 | B2 | 3/2010 | Fioravanti et al. | |
| 8,100,499 | B2 | 1/2012 | Mizes et al. | |
| 2002/0135629 | A1 | 9/2002 | Sarmast et al. | |
| 2003/0231350 | A1 | 12/2003 | Ymagishi | |
| 2004/0141022 | A1* | 7/2004 | Morimoto | 347/19 |
| 2004/0160468 | A1 | 8/2004 | Kim et al. | |
| 2005/0099447 | A1 | 5/2005 | Hsu et al. | |
| 2005/0179710 | A1 | 8/2005 | Tatsuta et al. | |
| 2006/0114283 | A1 | 6/2006 | Mizes et al. | |
| 2008/0062219 | A1 | 3/2008 | Mizes et al. | |
| 2009/0322849 | A1 | 12/2009 | Calamita et al. | |
| 2010/0013882 | A1 | 1/2010 | Mizes et al. | |
| 2010/0149555 | A1 | 6/2010 | Yenson et al. | |
| 2011/0242187 | A1* | 10/2011 | Mongeon et al. | 347/19 |
| 2011/0279505 | A1 | 11/2011 | Shin et al. | |
| 2012/0113184 | A1 | 5/2012 | Mizes et al. | |
| 2012/0206531 | A1 | 8/2012 | Mizes et al. | |
| 2013/0050321 | A1 | 2/2013 | Calamita | |

* cited by examiner

SYSTEM AND METHOD OF PRINTHEAD CALIBRATION WITH REDUCED NUMBER OF ACTIVE INKJETS

TECHNICAL FIELD

This disclosure relates generally to identification of printhead registration in an inkjet printer, and, more particularly, to analysis of image data to identify printhead registration using printed test patterns formed by all or only a portion of the inkjets in the printhead.

BACKGROUND

Inkjet printers operate a plurality of inkjets in each printhead to eject liquid ink onto an image receiving member. The ink can be stored in reservoirs that are located within cartridges installed in the printer. Such ink can be aqueous ink or an ink emulsion. Other inkjet printers receive ink in a solid form and then melt the solid ink to generate liquid ink for ejection onto the image receiving member. The image receiving member is, for example, a print medium such as paper or an indirect image receiving surface such as a belt or drum that receives ink for later transfer to a print medium.

A typical inkjet printer uses one or more printheads with each printhead containing an array of individual nozzles through which drops of ink are ejected by inkjets across an open gap to an image receiving member to form an ink image. The image receiving member can be a continuous web of recording media, a series of media sheets, or the image receiving member can be a rotating surface, such as a print drum or endless belt. Images printed on a rotating surface are later transferred to recording media by mechanical force in a transfix nip formed by the rotating surface and a transfix roller. An inkjet printhead typically includes a plurality of inkjet ejectors in which each inkjet ejects drops of ink onto an image receiving surface. A print engine in an inkjet printer processes image data to control the operation of individual inkjets in one or more printheads to form printed ink images on the image receiving surface.

In order for the printed images to correspond closely to the image data, both in terms of fidelity to the image objects and the colors represented by the image data, the printheads are registered with reference to the imaging surface and with the other printheads in the printer. Registration of printheads refers to a process in which the printheads are operated to eject ink in a known pattern and then the printed image of the ejected ink is analyzed to determine the relative positions of the printheads with reference to the imaging surface and with reference to the other printheads in the printer.

In existing systems, the printheads form printed test patterns with a comparatively large number of inkjets that are distributed across the face of the printhead in the cross-process direction. For example, in one embodiment a printhead operates 150 inkjets to form a printed test pattern that is used to identify the registration of the printhead. In many configurations, however, only a small portion of the inkjets in a printhead eject ink drops onto an image receiving surface. For example, in a direct continuous web printer configuration, a media web, such as an elongated roll of paper, passes the printheads in the print zone. The media path and the print zone accept media webs with different widths during different print jobs in the printer. In some duplex printer embodiments, a single media web passes through the print zone twice in tandem for first side printing with a first group of printheads and second side printing with a second group of printheads. In both configurations, some printheads only partially cover the width of the media web in the cross-process direction. In some configurations, only a single inkjet in a printhead is used to form the printed image. Existing printhead registration techniques that require a large number of inkjets in the printhead to form a printed test pattern are unable to perform printhead registration using the different configurations of the print medium. Additionally, even if the printhead is capable of printing onto the image receiving surface with all or a majority of the inkjets, existing image analysis techniques may still be susceptible to image data noise and misidentification of printed dashes that occur when inkjets operate only intermittently. Consequently, improvements to the printhead registration process that enable robust printhead registration using test patterns formed using a variable number of inkjets would be beneficial.

SUMMARY

In one embodiment, a method for operating an inkjet printer has been developed. The method includes ejecting a plurality of ink drops from an inkjet in a printhead to form a plurality of marks on an image receiving surface, each mark extending in a process direction on the image receiving surface, generating with an optical sensor image data of a predetermined portion of the image receiving surface that includes the plurality of marks, the image data including a two-dimensional arrangement of pixels with a plurality of pixel rows extending in a cross-process direction and a plurality of pixel columns extending in the process direction, identifying a plurality of amplitudes, each amplitude being identified for a portion of each pixel column in the image data of the predetermined portion of the image receiving surface, the portion of each pixel column including expected locations for a portion of the plurality of printed marks in the process direction, identifying a pixel column corresponding to one of the plurality of identified amplitudes having an absolute value that is a local maximum within the image data for the predetermined portion of the image receiving surface, identifying a cross-process direction location of the inkjet that ejected the ink drops in the identified pixel column with reference to the identified pixel column, and storing the identified cross-process direction location of the inkjet in a memory for use in printhead registration.

In another embodiment, a method of identifying roll in a printhead that is situated in a print zone of an inkjet printer has been developed. The method includes identifying a first cross-process direction distance between a first identified location of a first inkjet and a second identified location of a second inkjet in a printhead, the second inkjet being offset from the first inkjet in a cross-process direction and offset in a process direction from the first inkjet in the printhead, identifying a second cross-process direction distance between the identified location of the second inkjet and an identified location of a third inkjet in the printhead, the third inkjet offset from the second inkjet in the cross-process direction and offset in the process direction from the second inkjet in the printhead, and identifying a roll of the printhead with reference to the first identified distance and the second identified distance; and operating an actuator to rotate the printhead for correction of the identified roll.

In another embodiment, an inkjet printer has been developed. The printer includes a printhead including a plurality of inkjets, a media transport configured to move a print medium with an image receiving surface in a process direction past the printhead in a print zone, an optical sensor configured to detect light reflected from the image receiving surface of the print medium after the print medium moves past the printhead, and a controller operatively connected to the printhead, media transport, optical sensor, and a memory. The controller is configured to operate the media transport to move the print medium in the process direction past the plurality of inkjets in the printhead, operate the printhead to eject a plurality of ink drops from an inkjet in the printhead to form a plurality of marks on the image receiving surface of the print medium, each mark extending in a process direction on the image receiving surface, generate image data of a predetermined portion of the image receiving surface that includes the plurality of marks with the optical sensor, the image data including a two-dimensional arrangement of pixels with a plurality of pixel rows extending in a cross-process direction and a plurality of pixel columns extending in the process direction, identify a plurality of amplitudes, each amplitude being identified for a portion of each pixel column in the image data of the predetermined portion of the image receiving surface, the portion of each pixel column including expected locations for a portion of the plurality of printed marks in the process direction, identify a pixel column corresponding to one of the plurality of identified amplitudes having an absolute value that is a local maximum within the image data for the predetermined portion of the image receiving surface, identify a cross-process direction location of the inkjet that ejected the ink drops in the identified pixel column with reference to the identified pixel column, and store the identified cross-process direction location of the inkjet in the memory for use in printhead registration.

BRIEF DESCRIPTION OF THE DRAWINGS

The foregoing aspects and other features of a printer that generates a test pattern for printhead registration are explained in the following description, taken in connection with the accompanying drawings.

DETAILED DESCRIPTION

Figure 1:
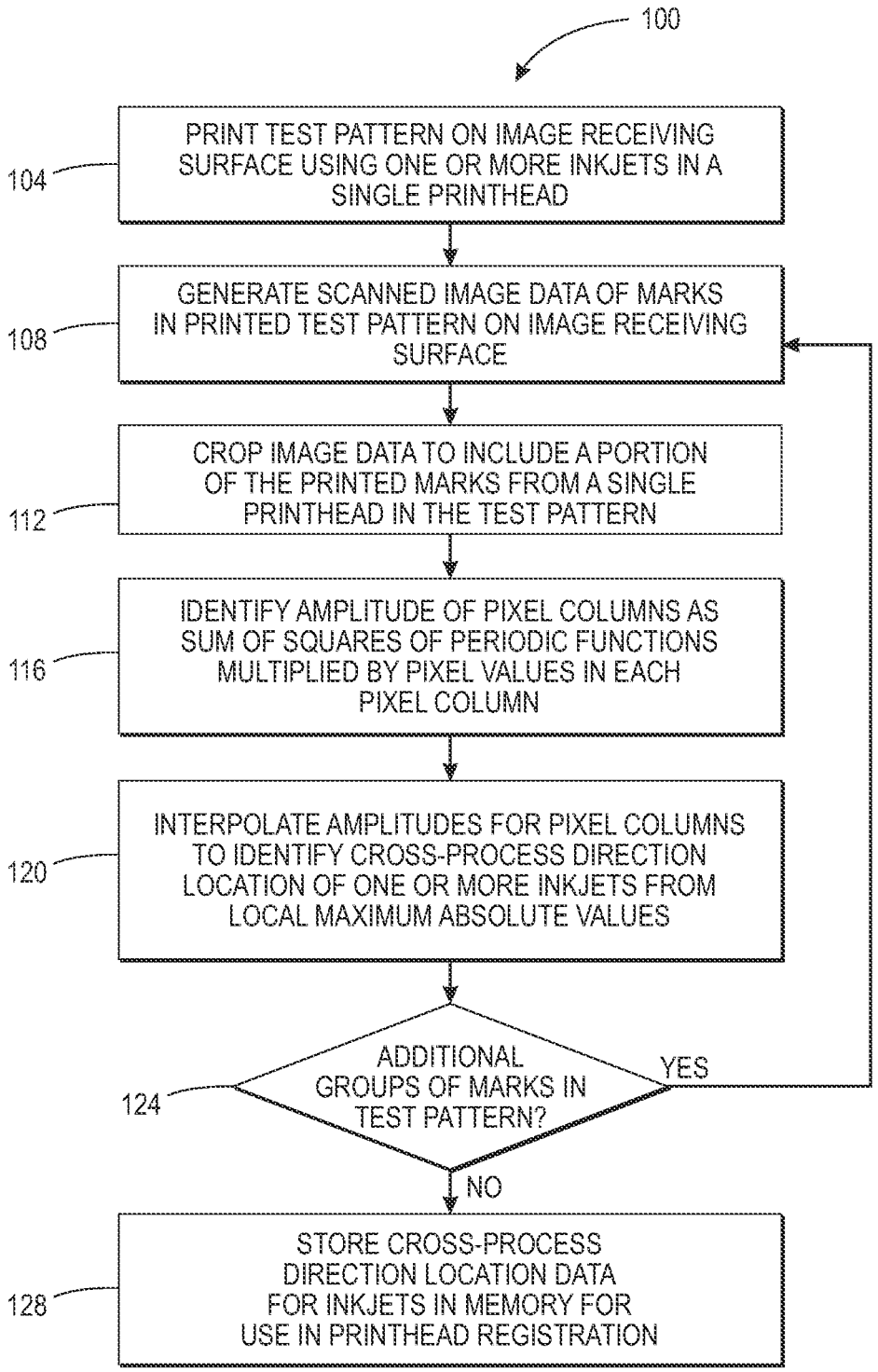
FIG. 1 is a block diagram of a process for identifying cross-process direction locations of one or more inkjets in a printhead from scanned image data of a printed pattern formed with the inkjets.

For a general understanding of the present embodiments, reference is made to the drawings. In the drawings, like reference numerals have been used throughout to designate like elements. As used herein, the terms "printer" generally refer to an apparatus that applies an ink image to print media and can encompass any apparatus, such as a digital copier, bookmaking machine, facsimile machine, multi-function machine, etc., which performs a print outputting function for any purpose. The printer prints ink images on an image receiving member, and the term "image receiving member" as used herein refers to print media or an intermediate member, such as a drum or belt, which carries an ink image and transfers the ink image to a print medium. "Print media" can be a physical sheet of paper, plastic, or other suitable physical substrate suitable for receiving ink images, whether precut or web fed. As used in this document, "ink" refers to a colorant that is liquid when applied to an image receiving member. For example, ink can be aqueous ink, ink emulsions, melted phase change ink, or gel ink that has been heated to a temperature that enables the ink to be liquid for application or ejection onto an image receiving member and then return to a gelatinous state. A printer can include a variety of other components, such as finishers, paper feeders, and the like, and can be embodied as a copier, printer, or a multifunction machine. An image generally includes information in electronic form, which is to be rendered on print media by a marking engine and can include text, graphics, pictures, and the like.

The term "printhead" as used herein refers to a component in the printer that is configured to eject ink drops onto the image receiving member. A typical printhead includes a plurality of inkjets that are configured to eject ink drops of one or more ink colors onto the image receiving member. The inkjets are arranged in an array of one or more rows and columns. In some embodiments, the inkjets are arranged in staggered diagonal rows across a face of the printhead. Various printer embodiments include one or more printheads that form ink images on the image receiving member. Some printer embodiments include a plurality of printheads arranged in a print zone. An image receiving member, such as a print medium or an intermediate member that holds a latent ink image, moves past the printheads in a process direction through the print zone. The inkjets in the printheads eject ink drops in rows in a cross-process direction, which is perpendicular to the process direction across the image receiving member.

As used herein, the term "dash" refers to a mark formed on an image receiving member that includes a series of ink drops extending in the process direction formed by a single inkjet in a printhead. A dash can be formed from ink drops located in adjacent pixels in the process direction on the image receiving member and can include a pattern of on/off adjacent pixels in the process direction. As used herein, the term "pixel" refers to a location on the image receiving member that receives an individual ink drop from an inkjet. Locations on the image receiving member can be identified with a grid-like pattern of pixels extending in the process direction and cross-process direction on the image receiving member. As used herein, the term "test pattern" refers to a predetermined arrangement of dashes formed on an image receiving member by one or more printheads in the printer. In some embodiments, a test pattern includes a predetermined arrangement of a plurality of dashes formed by some or all of the inkjets in the printheads arranged in the print zone.

As used herein, the term "reflectance value" refers to a numeric value assigned to an amount of light that is reflected from a pixel on the image receiving member. In some embodiments, the reflectance value is assigned to an integer value of between 0 and 255. A reflectance value of 0 represents a minimum level of reflected light, such as a pixel that is covered in black ink, and a reflectance value of 255 represents a maximum level of reflected light, such as light reflected from white paper used as an image receiving member. In other embodiments the reflectance value can be a non-integer value that covers a different numeric range. Some embodiments measure reflectance values that include multiple numeric values corresponding to different color separations such as red, green, and blue (RGB) values. In a test pattern that includes dashes printed on a highly reflective image receiving member, the image data corresponding to a dash have lower image reflectance values than the surrounding image receiving member.

As used herein, the term "scanned image data" refers to digital data corresponding to a plurality of reflectance values from a two-dimensional region of an image receiving surface, such as paper or an indirect image receiving member. The term "pixel row" refers to an arrangement of pixels extending in the cross-process direction across the image receiving surface, and the term "pixel column" refers to an arrangement of pixels extending in the process direction on the image receiving surface.

Figure 8:
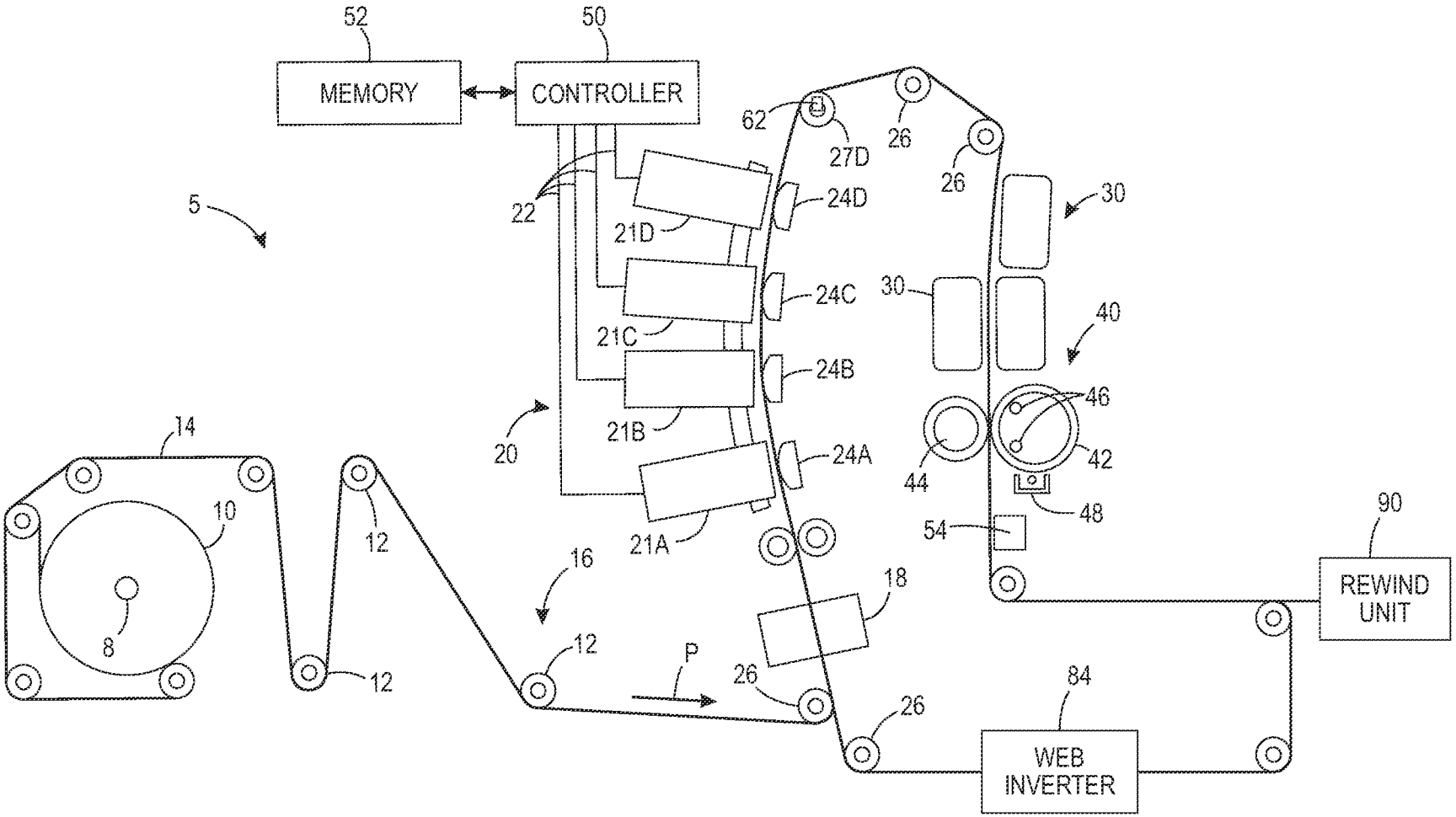
FIG. 8 PRIOR ART
FIG. 8 is a schematic diagram of a prior art inkjet printer.

FIG. 8 is a simplified schematic view of the direct-to-sheet, continuous-media, phase-change inkjet printer 5, that is configured to generate test patterns using a plurality of printheads positioned in a print zone in the printer. A media supply and handling system is configured to supply a long (i.e., substantially continuous) web of media 14 of "substrate" (paper, plastic, or other printable material) from a media source, such as spool of media 10 mounted on a web roller 8. The printer 5 includes a media transport that moves the media web 14 through the printer 5 in a process direction. The media transport includes one or more rollers, such as the rollers 12 and 26, which guide the media web 14 along the media path. Some of the rollers are connected to electrical actuators that rotate the rollers to propel the media web 14 at a predetermined velocity. For simplex printing, the printer includes the web roller 8, media conditioner 16, print zone or printing station 20, and rewind unit 90. For duplex operations, the web inverter 84 is used to flip the web to present a second side of the media to the printing station 20 before being taken up by the rewind unit 90. In the simplex operation, the media source 10 has a maximum width that substantially covers the width of the rollers 12 and 26 over which the media travels through the printer. In duplex operation, the media source has a maximum width approximately one-half of the roller widths as the web travels over one-half of the rollers in the printing station 20 before being flipped by the inverter 84 and laterally displaced by a distance that enables the web to travel over the other half of the rollers opposite the printing station 20 for the printing and conditioning, if necessary, of the reverse side of the web. The rewind unit 90 is configured to wind the web onto a roller for removal from the printer and subsequent processing.

The media can be unwound from the source 10 as needed and propelled by a variety of motors, not shown, rotating one or more rollers. The media conditioner includes rollers 12 and a pre-heater 18. The rollers 12 control the tension of the unwinding media as the media moves along a path through the printer. In alternative embodiments, the media can be transported along the path in cut sheet form in which case the media supply and handling system can include any suitable device or structure that enables the transport of cut media sheets along an expected path through the imaging device. The pre-heater 18 brings the web to an initial predetermined temperature that is selected for desired image characteristics corresponding to the type of media being printed as well as the type, colors, and number of inks being used. The pre-heater 18 can use contact, radiant, conductive, or convective heat to bring the media to a target preheat temperature, which in one practical embodiment, is in a range of about 30° C. to about 70° C.

The media are transported through a printing station 20 that includes a series of color units 21A, 21B, 21C, and 21D, each color unit effectively extending across the width of the media and being able to place ink directly (i.e., without use of an intermediate or offset member) onto the moving media. Each of the color units 21A-21D includes a plurality of printheads positioned in a staggered arrangement in the cross-process direction over the media web 14. As is generally familiar, each of the printheads can eject a single color of ink, one for each of the colors typically used in four color printing, namely, cyan, magenta, yellow, and black (CMYK). The controller 50 of the printer receives velocity data from encoders mounted proximately to rollers positioned on either side of the portion of the path opposite the four printheads to compute the position of the web as moves past the printheads. The controller 50 uses these data to generate timing signals for actuating the inkjets in the printheads to enable the four colors to be ejected with a reliable degree of accuracy for registration of the differently color patterns to form four primary-color images on the media. The inkjets actuated by the firing signals correspond to image data processed by the controller 50. The image data can be transmitted to the printer, generated by a scanner (not shown) that is a component of the printer, or otherwise electronically or optically generated and delivered to the printer. In various alternative embodiments, the printer 5 includes a different number of color units and can print inks having colors other than CMYK.

The printer 5 can use "phase-change ink," by which is meant that the ink is substantially solid at room temperature and substantially liquid when heated to a phase change ink melting temperature for jetting onto the imaging receiving surface. The phase change ink melting temperature can be any temperature that is capable of melting solid phase change ink into liquid or molten form. In one embodiment, the phase change ink melting temperature is approximately 70° C. to 140° C. In alternative embodiments, the ink utilized in the imaging device can comprise UV curable gel ink. Gel ink can also be heated before being ejected by the inkjets of the printhead. Alternative embodiments of the printer 5 use aqueous inks that are liquid at room temperature. As used herein, liquid ink refers to melted solid ink, heated gel ink, or other known forms of ink, such as aqueous inks, ink emulsions, ink suspensions, ink solutions, or the like.

Associated with each of color units 21A-21D is a corresponding backing member 24A-24D, respectively. The backing members 24A-24D are typically in the form of a bar or roll, which is arranged substantially opposite the printhead on the back side of the media. Each backing member is used to position the media at a predetermined distance from the printhead opposite the backing member. Each backing member can be configured to emit thermal energy to heat the media to a predetermined temperature which, in one practical embodiment, is in a range of about 40° C. to about 60° C. The various backer members can be controlled individually or collectively. The pre-heater 18, the printheads, backing members 24 (if heated), as well as the surrounding air combine to maintain the media along the portion of the path opposite the printing station 20 in a predetermined temperature range of about 40° C. to 70° C.

As the partially-imaged media web 14 moves to receive inks of various colors from the printheads of the print zone 20, the printer 5 maintains the temperature of the media web within a given range. The printheads in the color modules 21A-21D eject ink at a temperature typically significantly higher than the temperature of the media web 14. Consequently, the ink heats the media. Therefore, other temperature regulating devices may be employed to maintain the media temperature within a predetermined range. For example, the air temperature and air flow rate behind and in front of the media may also impact the media temperature. Accordingly, air blowers or fans can be utilized to facilitate control of the media temperature. Thus, the printer 5 maintains the temperature of the media web 14 within an appropriate range for the jetting of all inks from the printheads of the print zone 20. Temperature sensors (not shown) can be positioned along this portion of the media path to enable regulation of the media temperature.

Following the print zone 20 along the media path, the media web 14 moves over guide rollers 26 to one or more "mid-heaters" 30. A mid-heater 30 can use contact, radiant, conductive, and/or convective heat to control a temperature of the media. Depending on the temperature of ink and paper at rollers 26, this "mid-heater" can add or remove heat from the paper and/or ink. The mid-heater 30 brings the ink placed on the media to a temperature suitable for desired properties when the ink on the media is sent through the spreader 40. In one embodiment, a useful range for a target temperature for the mid-heater is about 35° C. to about 80° C. The mid-heater 30 has the effect of equalizing the ink and substrate temperatures to within about 15° C. of each other. Lower ink temperature gives less line spread while higher ink temperature causes show-through (visibility of the image from the other side of the print). The mid-heater 30 adjusts substrate and ink temperatures to 0° C. to 20° C. above the temperature of the spreader.

Following the mid-heaters 30, a fixing assembly 40 is configured to apply heat and/or pressure to the media to fix the images to the media. The fixing assembly includes any suitable device or apparatus for fixing images to the media including heated or unheated pressure rollers, radiant heaters, heat lamps, and the like. In the embodiment of FIG. 8, the fixing assembly includes a "spreader" 40, that applies a predetermined pressure, and in some implementations, heat, to the media. The function of the spreader 40 is to take what are essentially droplets, strings of droplets, or lines of ink on web 14 and smear them out by pressure and, in some systems, heat, so that spaces between adjacent drops are filled and image solids become uniform. In addition to spreading the ink, the spreader 40 also improves image permanence by increasing ink layer cohesion and/or increasing the ink-web adhesion. The spreader 40 includes rollers, such as image-side roller 42 and pressure roller 44, to apply heat and pressure to the media. Either roll can include heat elements, such as heating elements 46, to bring the web 14 to a temperature in a range from about 35° C. to about 80° C. In alternative embodiments, the fixing assembly can be configured to spread the ink using non-contact heating (without pressure) of the media after the print zone. Such a non-contact fixing assembly uses any suitable type of heater to heat the media to a desired temperature, such as a radiant heater, UV heating lamps, and the like.

In one practical embodiment, the roller temperature in spreader 40 is maintained at an optimum temperature that depends on the properties of the ink such as 55° C.; generally, a lower roller temperature gives less line spread while a higher temperature causes imperfections in the gloss. Roller temperatures that are too high may cause ink to offset to the roll. In one practical embodiment, the nip pressure is set in a range of about 500 to about 2000 psi lbs/side. Lower nip pressure gives less line spread while higher pressure may reduce pressure roller life.

The spreader 40 also includes a cleaning/oiling station 48 associated with image-side roller 42. The station 48 cleans and/or applies a layer of some release agent or other material to the roller surface. The release agent material can be an amino silicone oil having viscosity of about 10-200 centipoises. Only small amounts of oil are required and the oil carried by the media is only about 1-10 mg per A4 size page. In one possible embodiment, the mid-heater 30 and spreader 40 can be combined into a single unit, with their respective functions occurring relative to the same portion of media simultaneously. In another embodiment the media is maintained at a high temperature during the printing operation to enable the spreader 40 to spread the ink while the ink is in a liquid or semi-liquid state.

Following passage through the spreader 40 the printed media can be wound onto a roller for removal from the system (simplex printing) or directed to the web inverter 84 for inversion and displacement to another section of the rollers for a second pass by the printheads, mid-heaters, and spreader. The duplex printed material can then be wound onto a roller for removal from the system by rewind unit 90. Alternatively, the media can be directed to other processing stations that perform tasks such as cutting, binding, collating, and/or stapling the media or the like.

Operation and control of the various subsystems, components and functions of the printer 5 are performed with the aid of the controller 50. The controller 50 is implemented with general or specialized programmable processors that execute programmed instructions. The instructions and data required to perform the programmed functions are stored in a memory 52 that is operatively connected to the controller 50. The processors, their memories, and interface circuitry configure the controllers and/or print engine to perform the functions, such as the printhead registration functions described herein. These components are provided on a printed circuit card or provided as a circuit in an application specific integrated circuit (ASIC). In one embodiment, each of the circuits is implemented with a separate processor device. Alternatively, the circuits can be implemented with discrete components or circuits provided in VLSI circuits. Also, the circuits described herein can be implemented with a combination of processors, ASICs, discrete components, or VLSI circuits. As described in more detail below, the controller 50 executes stored program instructions from the memory 52 to print a test pattern on the media web 14 using one or more inkjets in one of the printheads in the print zone 20. The controller 50 identifies cross-process direction and process direction location data about the inkjets and the printhead using scanned image data that are generated with the optical sensor 54 from the printed test pattern. The controller 50 stores the location data in the memory 52 for use in performing registration for one or more printheads in the print zone 20. The controller 50 optionally prints test patterns and identifies the locations of inkjets for multiple printheads in the print zone 20.

The printer 5 includes an optical sensor 54 positioned after the print zone. In the printer 5, the optical sensor 54 is located after the spreader 40 in the process direction P. In other embodiments, the optical sensor is located before the spreader and/or mid-heater on the media path. The optical sensor 54 is configured to detect, for example, the presence, reflectance values, and/or location of ink drops jetted onto the web media by the inkjets of the printhead assembly. In one embodiment, the optical sensor 54 includes a light source and a linear array of light detectors. The light source can be a single light emitting diode (LED) with a broad spectrum that is coupled to a light pipe that conveys light generated by the LED to one or more openings in the light pipe that direct light towards the image substrate. In one embodiment, three LEDs, one that generates green light, one that generates red light, and one that generates blue light are selectively activated so only one light shines at a time to direct light through the light pipe and be directed towards the image substrate. In another embodiment, the light source is a plurality of LEDs arranged in a linear array. The LEDs in this embodiment direct light towards the image substrate. The light source in this embodiment can include three linear arrays, one for each of the colors red, green, and blue. Alternatively, all of the LEDS are arranged in a single linear array in a repeating sequence of the three colors. The LEDs of the light source can be coupled to the controller 50 or some other control circuitry to activate the LEDs for image illumination.

The reflected light is measured by the optical detectors in optical sensor 54. The optical sensor, in one embodiment, is a linear array of photosensitive optical detectors, such as charge coupled devices (CCDs) or complementary metal oxide (CMOS) elements. In the printer 5, the optical sensor 54 includes a linear array of more than 12,000 photosensitive optical detectors that extend across the width of the media web 14. Each photosensitive optical detector detects light reflected from an area of the surface of the media web 14 that is approximately one pixel in size. As the media web 14 moves past the optical sensor 54, the optical sensor 54 generates successive lines of image data, referred to as scan lines, that the controller 50 assembles into a two-dimensional array of image data corresponding to a section of the length of the media web 14 in the process direction and the width of the media web 14 in the cross-process direction. Each of the optical detectors in the optical sensor 54 generates image data corresponding to a portion of the media web 14 opposite the detector. Thus, the position of ink drops or other markings in the cross-process direction can be identified with reference to the one or more optical detectors that detect light corresponding to the dashes or other markings on the media web 14.

FIG. 1 depicts a process 100 for identifying the cross-process location of one or more inkjets in a printhead from scanned image data that are generated from a printed test pattern formed by the inkjets in the printhead. In the description below, a reference to the process 100 performing an action or a function refers to a digital processor or controller, such as the controller 50, performing stored programmed instructions to operate one or more of the components in the printer 5 or to analyze digital data received from the components in the printer 5. The process 100 is described with reference to the printer 5 of FIG. 8 for illustrative purposes.

Figure 3:
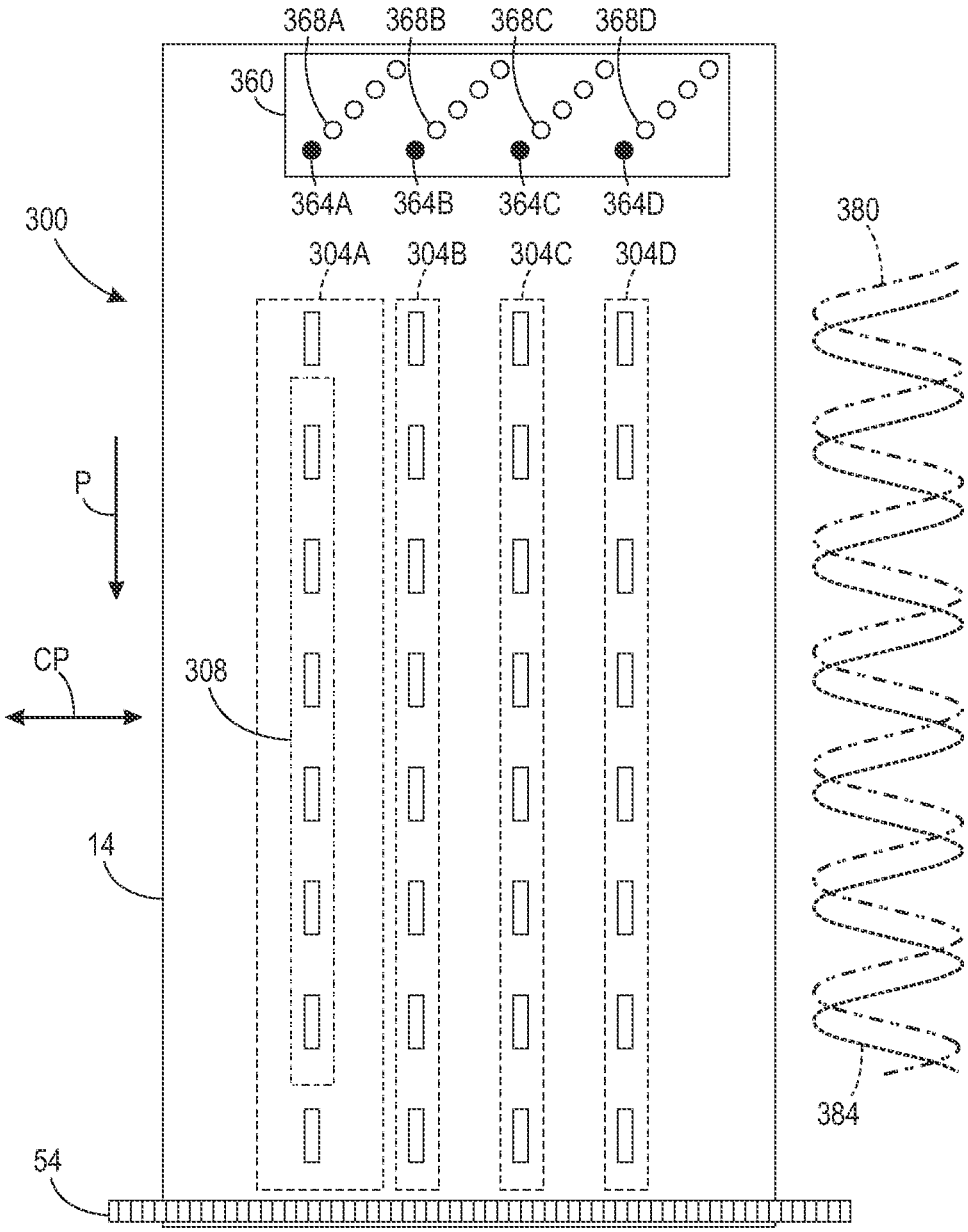
FIG. 3 is a diagram depicting a printed test pattern for use in identifying the cross-process direction and process direction locations of the inkjets in the printhead.

During process 100, a printhead in the print zone 20 ejects a pattern of ink drops that forms a test pattern on an image receiving surface, such as the media web 14 (block 104). FIG. 3 depicts a portion of a test pattern 300 formed on the web 14. FIG. 3 depicts a simplified illustration of a printhead 360 that includes a plurality of inkjets that eject ink drops onto the media web 14. In FIG. 3, the inkjets 364A-364D each eject drops to form the printed marks in the columns 304A-304D, respectively. The inkjets 364A-364D are separated from one another by a predetermined distance in the cross-process direction CP, and the corresponding columns of printed marks are also separated by a corresponding distance in the cross-process direction. In the illustrative embodiment of the test pattern 300, each mark is formed as a dash that includes several ink drops that are arranged in the process direction P. The controller 50 operates each of the inkjets 364A-364D to form the dashes with a predetermined process direction separation between the printed dashes in each of the dash columns. Each inkjet in the printhead forms a single column of printed marks that extend in the process direction P to form a portion of the printed pattern 300. FIG. 3 depicts a portion of a printed test pattern 300, but a larger test pattern optionally includes multiple groups of printed marks formed by additional inkjets in a similar pattern to the pattern of FIG. 3. FIG. 3 depicts multiple inkjets in the printhead that form the test pattern 300, but process 100 is also suitable for use with test patterns formed by a single inkjet that forms a single column of printed marks.

Referring to FIG. 1 and FIG. 3, an optical sensor generates scanned image data of the image receiving surface including the printed marks in the test pattern (block 108). In the printer 5, the optical scanner 54 generates scanned image data as a plurality of scanlines corresponding to the media web 14 as the media web 14 moves past the optical sensor 54 in the process direction P. The optical sensor 54 includes a plurality of photodetectors that are arranged in the cross-process direction CP. Each photodetector generates a single pixel in a scanline, and each scanline includes a row of pixels extending in the cross-process direction CP. The optical sensor 54 generates successive scanlines of image data as the media web 14 moves past the optical sensor 54 in the process direction P to form a two-dimensional scanned image of the printed test pattern 300 on the media web 14 from a series of scanlines.

Each pixel of the scanned image data corresponds to a region of the media web 14 with predetermined dimensions in the process direction P and the cross-process direction CP. The optical sensor 54 generates digital data reflectance values corresponding to the amount of reflected light that is received from the region of the media web 14 that corresponds to each pixel. In one embodiment, the reflectance values are represented as 8-bit digital data on a scale of 0 to 255 where 0 corresponds to a minimum level of reflectance and 255 corresponds to a maximum level of reflectance. In an embodiment in which the media web 14 is white paper, the reflectance values for bare portions of the media web 14 are higher than the reflectance values for printed ink marks, such as the printed dashes in the test pattern 300. As described in more detail below, during process 100, the controller 50 identifies the locations of the printed marks in the printed test pattern and the corresponding locations of inkjets in the printhead using the scanned image data.

Process 100 continues as the controller 50 crops the scanned image data including the printed marks in the test pattern (block 112). In one embodiment, the controller 50 crops the scanned image data in the process direction P to remove a portion of the image data that corresponds to the length of the first mark and final mark in the printed test pattern. For example, in FIG. 3 the controller 50 crops the scanned image data for the printed marks 304A in the test pattern 300 to include only the printed marks in the column 308. The cropping procedure removes printed marks at both ends of the printed test pattern 300 in the process direction to reduce errors that are generated due to potential process direction calibration issues with the printhead 360 or the optical sensor 54.

Process 100 continues as the controller 50 identifies amplitude values for columns of pixels in the cropped image data (block 116). To identity an amplitude corresponding to a column of pixels, the controller 50 multiplies the value of each pixel in a pixel column by a value of two periodic functions with a period corresponding to the expected separation between the centers of printed marks in the test pattern. The controller 50 identifies a sum of the squares for the products of the periodic functions. In one embodiment, the periodic functions are the sine and cosine functions with periods that correspond to the expected number of pixels between the centers of the printed dashes. For example, FIG. 3 depicts graphs of a sine function 380 and cosine function 384. The values of the sine function 380 and cosine function 384 are multiplied by the pixel values of the image data at the corresponding locations along each pixel column in the cropped image data.

The amplitude value for each pixel column is set forth in the following equation:

$$A = 1 - \frac{\sum_{n=0}^{L}\left(P(n)\cos\left(\frac{2\pi n}{D}\right)\right)^2 + \sum_{n=0}^{L}\left(P(n)\sin\left(\frac{2\pi n}{D}\right)\right)^2}{L}$$

where P represents the pixel column with each pixel at index n including a numeric reflectance value, L is the number of pixels in the column of image data, and D is the expected number of pixels between the centers of each dash in the test pattern. Pixel columns that include printed dashes have a strong correlation with the periodic sine and cosine functions, which produce an amplitude with a larger absolute value, while pixel columns that include pixels corresponding to the media web 14 have amplitude values near zero. Using the equation above, the amplitude values for pixel columns that include printed marks have large negative numeric values. In another embodiment, the amplitude equation produces larger positive numeric values for the pixel columns that include the printed marks. In either embodiment, the absolute value of the amplitudes for pixel columns that correspond to printed marks differ from the amplitudes of the pixel columns for the bare image receiving surface to enable identification of the printed marks.

Figure 4:
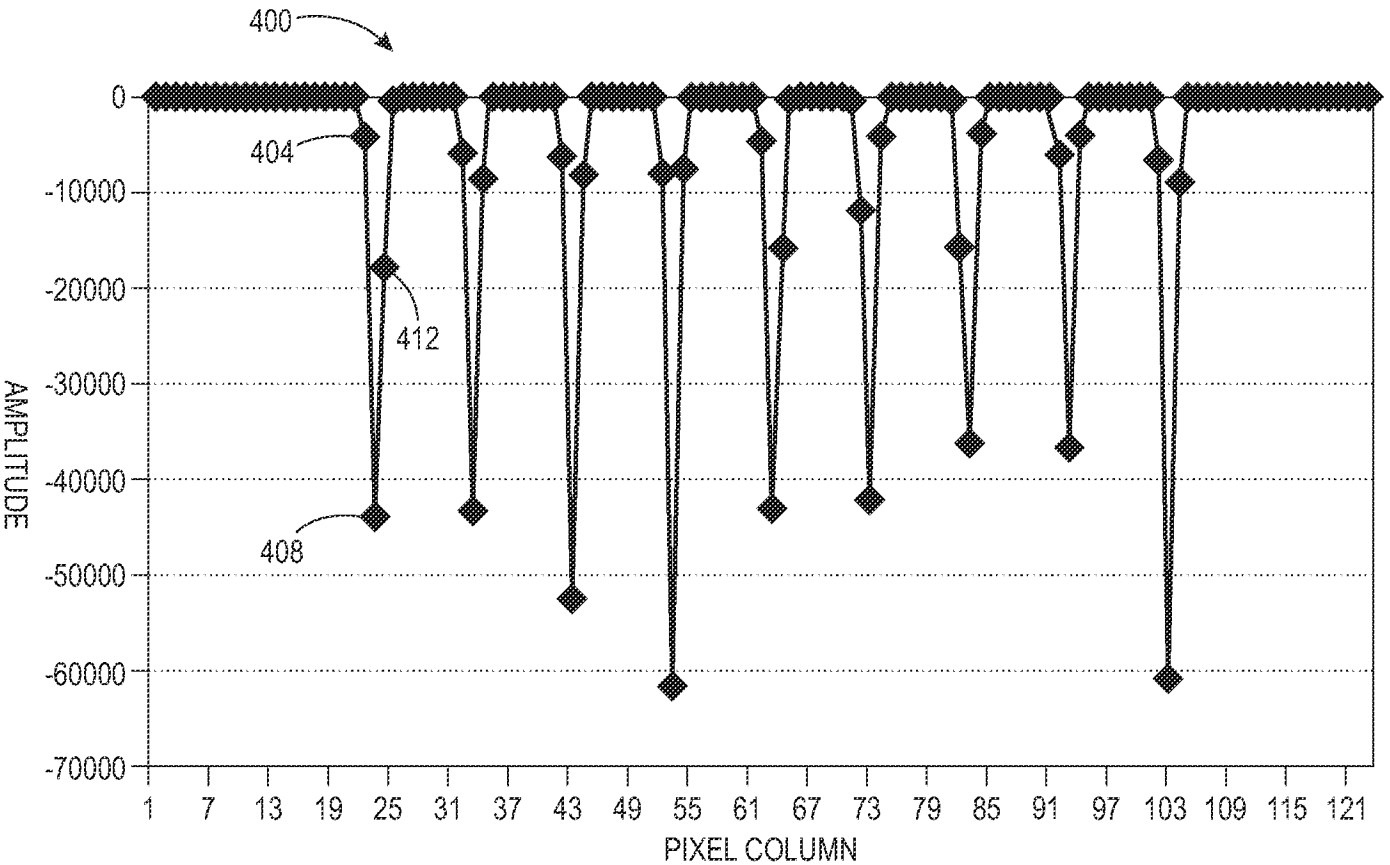
FIG. 4 is a diagram depicting identified amplitudes for pixel columns of scanned image data including a printed test pattern.

Process 100 continues as the controller 50 identifies pixel columns in the image data that include the printed marks through interpolation of the identified amplitude values for each pixel column (block 120). In one embodiment, the controller 50 identifies pixel columns that include the printed dashes using quadratic interpolation of the amplitude values. FIG. 4 depicts a graph 400 of the amplitudes for different pixel columns in sample image data. In FIG. 4, the amplitude values with local minima in the graph correspond to the pixel column locations of printed dashes. For example, the local minimum 408 includes a local minimum amplitude value for a column of dashes with neighboring pixel columns 404 and 412 having intermediate amplitudes because the neighboring pixel columns include portions of the printed dashes. The quadratic interpolation process generates quadratic curves that fit the identified amplitude values for the pixel columns. The peaks of the quadratic curves correspond to pixel columns with maximum absolute amplitude values, where the graph 400 depicts negative valued peaks with the maximum absolute amplitude value approximately zero. In alternative embodiments, the controller 50 uses another form of interpolation, a thresholding process, or another suitable identification method to identify the pixel columns with the amplitudes that correspond to the printed dashes.

The processing described above with reference to blocks 112-120 in FIG. 1 continues for additional groups of marks, if any, in the printed test pattern (block 124). For example, in FIG. 3, the inkjets 368A-368D eject ink drops to form another group of dashes that are similar to the group of dashes 304A-304D, but are located at the cross-process direction positions of the inkjets 368A-368D. The printed dashes from the inkjets 368A-368D are formed on another portion of the media web 14 that is offset from the printed marks 304A-304D in the process direction P. The controller 50 identifies the pixel columns corresponding to the inkjets 368A-368D in scanned image data of the printed dashes in the same manner described above for the printed marks from different groups of inkjets in the printhead 350.

Process 100 continues as the controller 50 stores the identified cross-process direction locations of the inkjets in the printhead that formed the printed test pattern in the memory 52 (block 128). The stored cross-process direction location data are used for printhead registration processes to align one or more printheads prior to forming printed pages. Additionally, if the controller 50 identifies inoperable inkjets, the controller 50 stores data identifying the inoperable inkjets in the memory 52. The printer 5 optionally performs inoperable inkjet compensation processes during a print job to reduce the impact of the inoperable inkjets on printed images.

As described above, the process 100 is optionally performed for one or more inkjets in a single printhead. In the embodiment of the printer 5, the inkjets are formed in fixed locations in each printhead, and the memory 52 stores the data corresponding to the identified locations of the inkjets in the cross-process direction for use in various printhead registration and calibration processes that are known to the art. During operation, the printer 5 performs the process 100 for one or more printheads in the print zone 20. The printer 5 optionally performs the process 100 for multiple printheads simultaneously if the multiple printheads can form printed test patterns on different regions of the media web. The printer 5 can generate groups of printed test patterns using selected inkjets in each of the printheads of the printhead units 21A-21D. The printer 5 optionally performs additional processing related to the printed test patterns that are formed during process 100 including, but not limited to, identification of the relative locations of printed marks in the process direction and identification of printhead roll for one or more printheads in the printer. The printer 5 performs the additional processes concurrently with process 100 or separately from the process 100 in different embodiments.

The identification of the cross-process direction locations for individual inkjets using pixel columns of image data enables the process 100 to identify the locations of a small number of inkjets, including only a single inkjet, in a single printhead. In configurations where only one inkjet or a small number of inkjets are aligned with an image receiving surface, the process 100 enables identification of a limited number of inkjets in a printhead for printhead registration without requiring that the image receiving surface be realigned to capture ink drops that are ejected from a large number of inkjets in the printhead. As is apparent to those of ordinary skill in the art, the process 100 is also applicable to the identification of inkjet locations in printheads where a large portion or all of the inkjets are aligned with the image receiving surface to form printed images as well.

Figure 2:
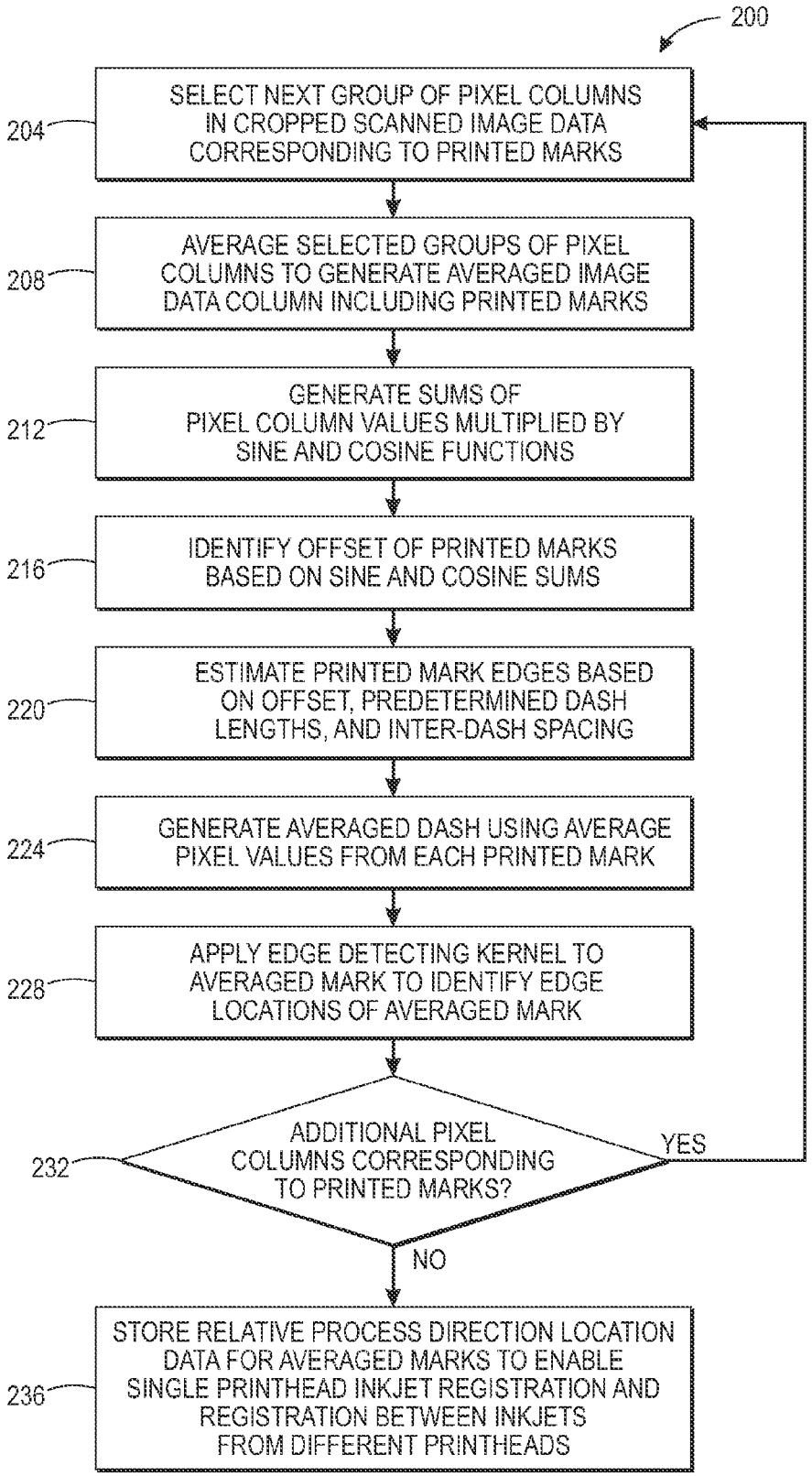
FIG. 2 is a block diagram of a process for identifying process direction locations of one or more inkjets in a printhead from scanned image data of a printed pattern formed with the inkjets.

The process 100 of FIG. 1 enables identification of the locations of inkjets and the printhead that includes the inkjets in the cross-process direction in the print zone. FIG. 2 depicts another process 200 that uses the scanned image data of the printed test pattern is also used to identify relative process direction location of the printhead in the print zone. In the printer 5, the media web 14 moves past each of the printheads in the process direction. The controller 50 and printhead controllers in the printhead units 21A-21D control the generation of firing signals for the inkjets to adjust the process direction location of the printed ink drops on the media web 14. During a registration process, the controller 50 identifies process direction offset, if any, in the image data of the test pattern to identify whether the printed marks from the inkjets in the printhead are formed in an expected location on the media web. In the description below, a reference to the process 200 performing an action or a function refers to a digital processor or controller, such as the controller 50, performing stored programmed instructions to operate one or more of the components in the printer 5 or to analyze digital data received from the components in the printer 5. The process 200 is described with reference to FIG. 5 and the printer 5 of FIG. 8 for illustrative purposes.

In the embodiment of FIG. 2, the process 200 begins with selection of one or more pixel columns from cropped scanned image data corresponding to printed marks formed on the media web 14 (block 204). In the embodiment of FIG. 2, the printer 5 forms a printed test pattern, generates cropped scanned image data of the test pattern, and identifies pixel columns in the cropped scanned image data corresponding to the printed marks in the same manner as described above in the process 100. The process 200 uses the cropped scanned image data for identification of a process direction offset for the printed marks in the scanned image data, and to identify an average process direction location of the printed marks.

Figure 5:
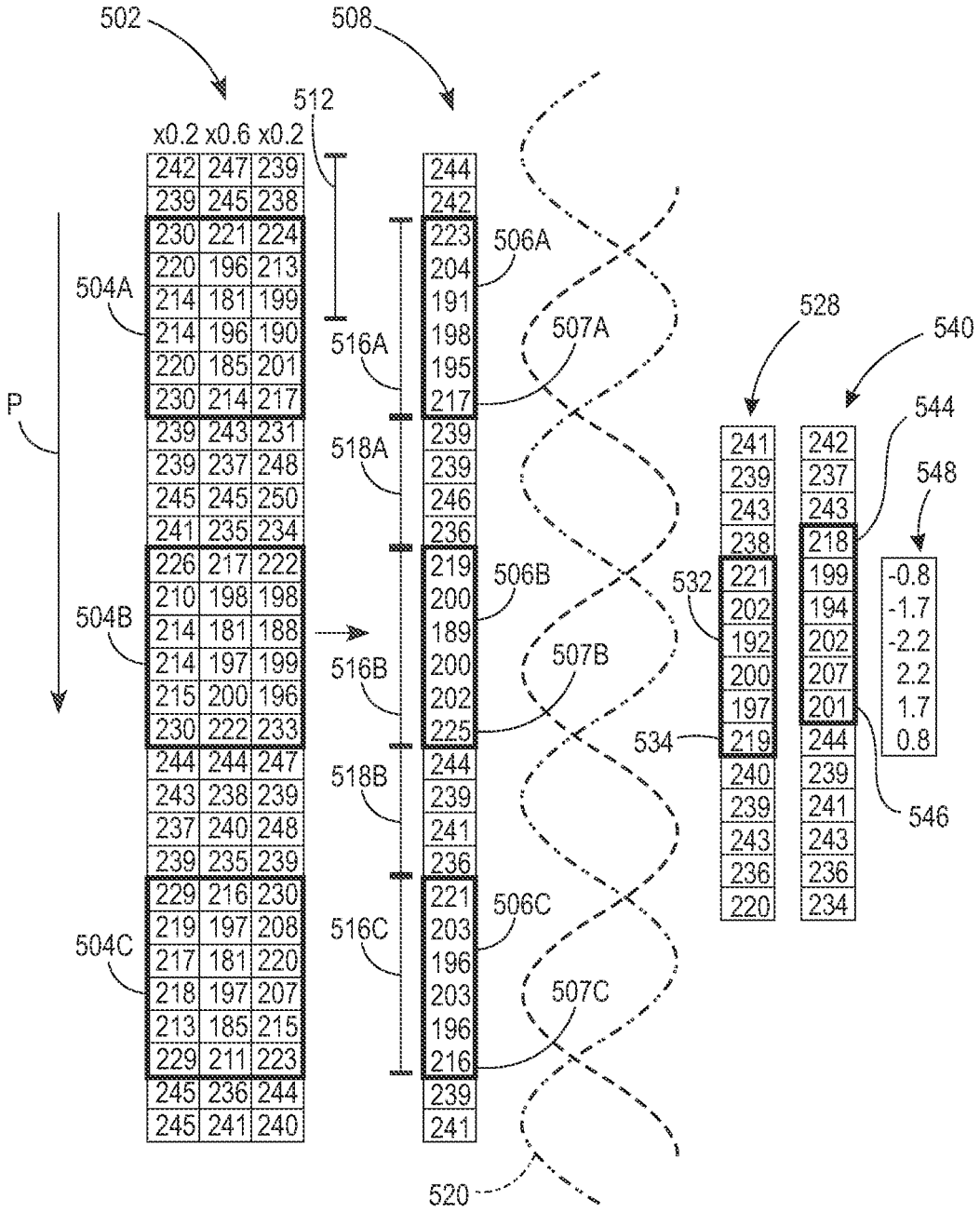
FIG. 5 is a diagram depicting image data corresponding to printed marks formed by an inkjet in a printhead and image data corresponding to an averaged mark that is used for identifying relative process direction locations of the printed marks from the inkjet compared to other inkjets in the printhead or from different printheads in the printer.

In one embodiment, the controller 50 generates averaged image data corresponding to multiple pixel columns of image data that are proximate to the identified marks (block 208). For example, as depicted in FIG. 4, the amplitude for a pixel column 408 that includes a series of printed marks. The adjacent pixel columns 404 and 412 also include portions of the printed marks with amplitude levels that differ from the average amplitude of the blank image receiving surface. As depicted in FIG. 5, three adjacent columns of pixel data 502 include the reflectance values corresponding to printed marks 504A, 504B, and 504C that are arranged with predetermined gaps in the process direction P. The controller 50 generates a single averaged column of pixel data 508 using a weighted average of the image data in the pixel columns 502, with the example of FIG. 5 depicting a relative weight factor of 0.6 for the central pixel column and weights of 0.2 for each of the adjacent pixel columns in the image data 502. The use of averaged image data in the pixel column reduces the effects of noise in the image data and improves the accuracy of identifying edges of the printed marks in the image data.

During process 200, the controller 50 generates two sums of the reflectance values in each pixel in the averaged image data pixel column multiplied by a sine function and cosine function, respectively (block 212). FIG. 5 depicts the average pixel column 508, a sine function 520 and a cosine function 524. As depicted in FIG. 5, the sine function and the cosine function each have a period corresponding the predetermined distance between the centers of the printed dashes in the cropped image data 308. The controller 50 generates a sum of the products of the reflectance values in the pixel column multiplied by the corresponding value of the sine function 504 at each pixel location in the process direction P. The sum of the sine products is set forth in the following equation:

$$\sum_{sin} = \sum_{n=1}^{L} P(n)\sin\left(\frac{2\pi n}{D}\right),$$

where L is the number of pixels in the cropped pixel column, P corresponds to the reflectance value of each pixel at index n, and D is the predetermined number of pixels between the centers of dashes in the printed test pattern. The controller 50 generates another sum of the products of the reflectance values in the pixel column multiplied by the corresponding value of the cosine function 508 at each pixel location in the process direction P. The sum of the cosine products is set forth in the following equation:

$$\sum_{cos} = \sum_{n=1}^{L} P(n)\cos\left(\frac{2\pi n}{D}\right).$$

The sums of the cosine and sine products vary in response to an offset of the printed marks in the pixel column 308 along the process direction P within the pixel column. As depicted in FIG. 5, the sine function 504 has peak amplitudes in locations of the image data that lie between the printed marks, while the cosine function 508 has amplitude peaks that correspond to the locations of the printed marks. Thus, the term $\Sigma_{sin}$ has a minimum value where the peaks of the sine function are aligned between the printed marks in the image data, and the term $\Sigma_{cos}$ has a maximum value where the peaks of the cosine function are aligned with the printed marks.

Process 200 continues as the controller 50 identifies a process direction offset for the printed marks in the pixel column using the identified sums of the sine and cosine products (block 216). The controller 50 identifies the offset using the following equation:

$$\text{offset} = \left[\frac{\pi}{2} + \arctan\left(\frac{\Sigma_{sin}}{\Sigma_{cos}}\right)\right] + \frac{RowLength}{2\pi},$$

where RowLength is the predetermined number of pixels in the pixel column for the length of a single printed dash and the process direction separation between the dash and the next dash in the test pattern. The offset corresponds to a number of pixels from one end of the pixel column to a center of a first dash in the printed column of dashes. Due to variations in the cropping of the image data, the first end of the pixel column may correspond to an incomplete portion of a printed dash or to a blank region of the image receiving surface between the printed dashes. The identification of the offset in the process 200 enables the controller 50 to identify the edges and centers of printed dashes that are completely contained in the cropped image data. In the example of FIG. 5, the dimension line 512 corresponds to the identified offset from one end of the averaged pixel column 508 to the center of an averaged dash 506C.

Process 200 continues with estimation of the locations for the edges of the printed marks in the averaged pixel column using the identified pixel offset for the marks, a predetermined number of pixels in each printed mark, and a predetermined number of pixels that separate the marks (block 220). As described above, each printed mark in the test pattern is formed from a predetermined number of ink drops with a predetermined length in the process direction. The marks are also formed at predetermined intervals in the process direction. During printing, the locations and dimensions of the printed marks that are actually formed on the media web may exhibit some variations from the predetermined dimensions. Thus, the controller 50 generates an estimate of the pixel locations of the edges of each of the printed marks in the image data. As depicted in FIG. 5, the offset 512 identifies the center of the first printed mark 506A, and the dimension line 516A corresponds to the predetermined dimension of the printed mark in the process direction P. The controller 50 generates an estimate of at least one end of the printed mark, such as the end 507A. In FIG. 5, the controller 50 uses the predetermined gaps 518A and 518B and the predetermined mark dimensions 516B and 516C with the offset 512 to estimate the locations of the ends 507B and 507C of the printed marks 506B and 506C, respectively.

During process 200, the controller 50 generates an averaged dash using the averaged image data of the printed column of marks and the estimated locations of the pixels corresponding to the printed marks in the column (block 224). Due to variations in the printing process, the estimated locations of the printed marks mark edges may vary from the actual locations of the edge of each mark. The controller 50 generates a synthetic mark, which is referred to as an "averaged mark" or "averaged dash", using averages for the pixels in the image data corresponding to each dash. For example, in FIG. 5 depicts an averaged dash 532 where each pixel in the averaged dash is an average of corresponding pixels taken from the estimated locations of the dashes 506A-506C. For example, the reflectance value of the pixel 534 in the averaged dash 532 is the average value of the reflectance values in the pixels 507A, 507B, and 507C. The averaged dash is formed in a larger column of pixels 528 where the surrounding pixels are averaged values of the gaps between the printed marks in the pixel column 508. The controller 50 generates the averaged dash 532 to reduce the effects of variation in the locations of the edges for the individual printed marks 506A-506C due to variations in the printing process.

Process 200 continues as the controller 50 uses an edge detection kernel to identify a process direction location of at least one edge of the averaged mark in the image data (block 228). In one embodiment, the controller 50 performs a convolution of a predetermined array of numeric coefficients that form an edge detection kernel to the image data column 528. The controller 50 identifies the edges of the averaged dash 532 from the results of the convolution. In the example of FIG. 5, the controller 50 applies an illustrative edge detection kernel 548 to the pixel column 528 to identify the edges of the averaged mark 532 in the pixel column 528. The controller 50 identifies a pixel location for the pixel 534 that corresponds to one edge of the averaged dash 532 in the image data column 528. The identified location of the edge of the averaged dash 532 is a relative in the pixels in the pixel column 528.

Process 200 continues for any additional pixel columns in the cropped image data that include printed marks (block 232). The image data captured for the printed test pattern include printed marks from multiple inkjet in a single printhead or from inkjets in two or more printheads in the print zone. During process 200, the controller 50 processes the pixel columns of image data for additional sets of printed marks and generates averaged dash image data in pixel columns that are similar to the pixel column 528 in FIG. 5. For example, in FIG. 5 the pixel column 540 includes another averaged dash 544 that is generated from the image data of printed marks from another inkjet in the print zone. The relative process direction location of the averaged dash 544 in the pixel column 540 differs from the dash 532. The controller 50 identifies the pixel location of the edge 546 for the average dash 544. Thus, during process 200 the controller 50 generates averaged dashes for multiple inkjets and identifies differences in the relative process direction locations of the multiple inkjets to characterize the process direction registration of inkjets in a single printhead or between inkjets in multiple printheads.

The controller 50 stores the relative process direction locations of the averaged mark in the memory 52 in association with each of the inkjets that forms the printed test pattern (block 236). In one embodiment, the printer 5 uses the stored process direction location data to identify errors in the process direction registration between inkjets in a single printhead and between multiple printheads in the printer.

Figure 6:
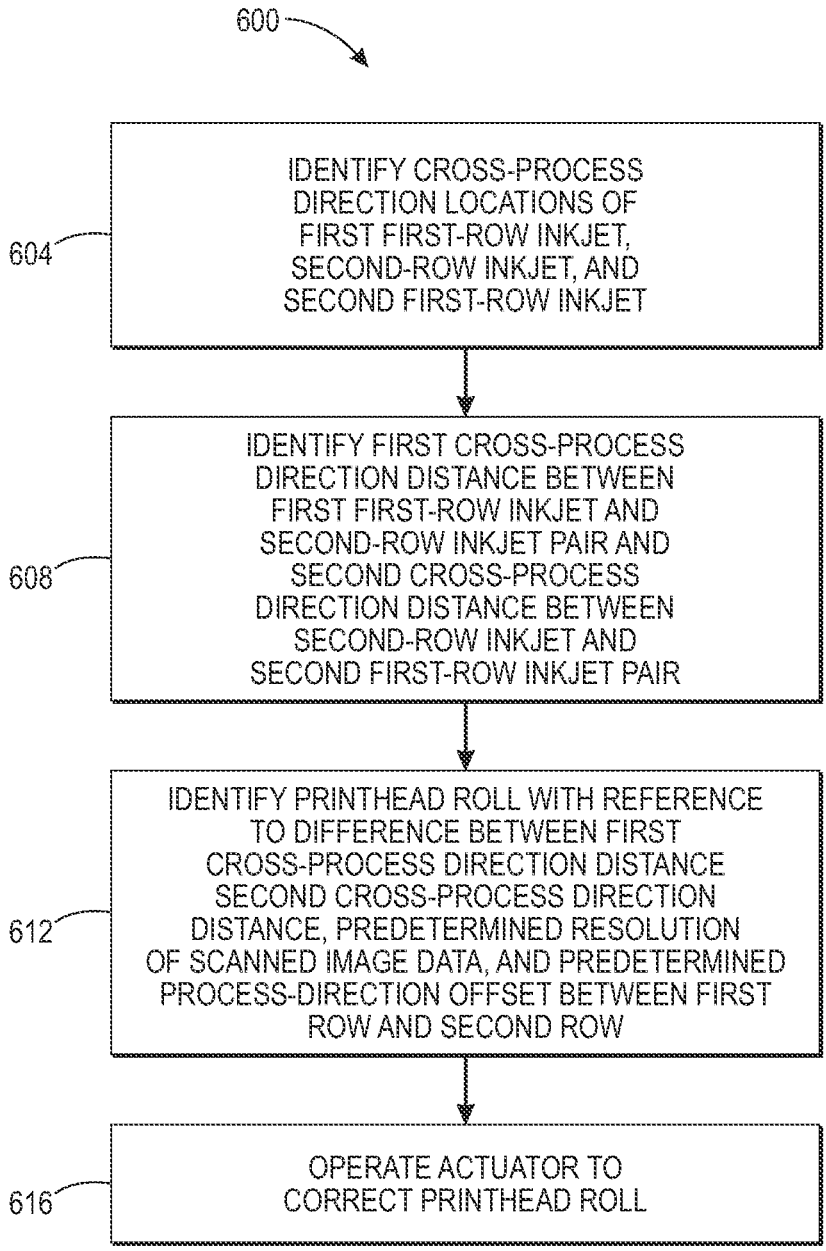
FIG. 6 is a block diagram of a process for identifying printhead roll in an inkjet printhead.

FIG. 6 depicts a block diagram of a process 600 for identifying printhead roll in an inkjet printer. As used herein, the term "printhead roll" refers to rotation of a printhead around an axis that is perpendicular to an image receiving surface, such as the surface of the media web 14 in the printer 5. In the description below, a reference to the process 600 performing an action or a function refers to a digital processor or controller, such as the controller 50, performing stored programmed instructions to operate one or more of the components in the printer 5 or to analyze digital data received from the components in the printer 5. The process 600 is described with reference to the printer 5 of FIG. 8 for illustrative purposes.

Figure 7A:
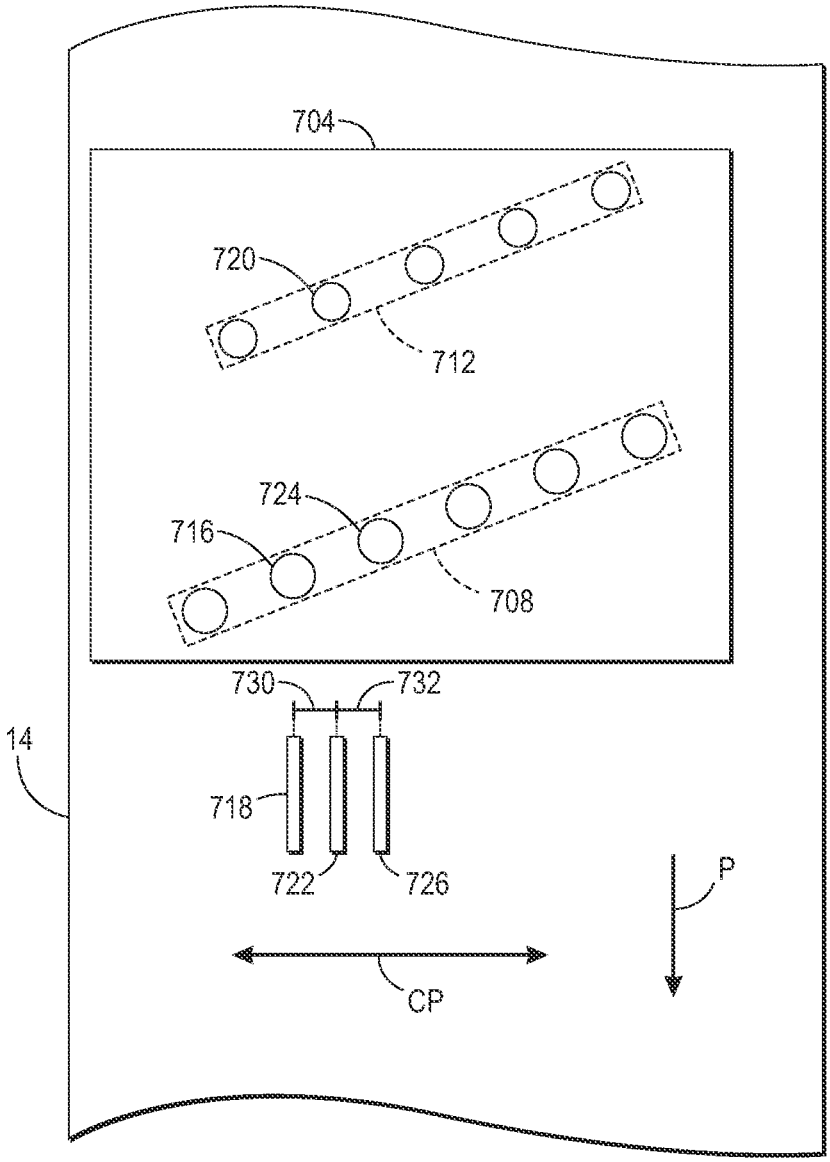
FIG. 7A is a diagram of an inkjet printhead with zero printhead roll.

The process 600 identifies printhead roll based on variations between the cross-process direction locations of inkjets in the printhead. FIG. 7A depicts a simplified view of a printhead 704 that includes a first row of inkjets 708 and a second row of inkjets 712. For illustrative purposes, in FIG. 7A the first inkjet row 708 includes a first inkjet 716 and second inkjet 724. The second row of inkjets 712 includes an inkjet 720 that is located between the first inkjet 716 and the second inkjet 724 in the cross-process direction CP. The printhead 704 is a simplified printhead with two rows of inkjets that are each arranged in a diagonal line on the face of the printhead 704. Other printhead embodiments include more than two rows of inkjets in different arrangements. As described herein, the process 600 is suitable for use with any arrangement of inkjet rows where two inkjets in one row are offset from each other by a predetermined distance in the cross-process direction and an inkjet in another row is located between the two inkjets in the cross-process direction and offset from the two inkjets by a predetermined distance in the process direction.

Process 600 begins with identification of the cross-process direction locations of three inkjets in the printhead that correspond to a first and second inkjet in a first row of the printhead, and another inkjet that is located in a second row of the printhead between the first and second inkjets in the cross-process direction (block 604). In one embodiment, the controller 50 performs the process 100 described above to print marks using the inkjets 716, 720, and 724 to identify the cross-process locations of the inkjets. In FIG. 7A, the printhead 704 is depicted in a configuration without printhead roll. Printed marks 718, 722, and 726 are part of a printed pattern and correspond to the locations of the inkjets 716, 720, and 724, respectively. As described above, the controller 50 processes scanned image data of one or more printed marks to identify the locations of the corresponding inkjets and the cross-process direction distance between the inkjets based on the printed marks in a test pattern.

Process 600 continues as the controller 50 identifies two cross-process direction distances corresponding to the distance between a first pair of inkjets including the first first-row inkjet and the inkjet in the second row, and another pair of inkjets including the second-row inkjet and the second first-row inkjet (block 608). In one embodiment, the controller 50 identifies the distances using the cross-process direction locations of the inkjets that are generated from the scanned image data of the printed marks on the media web 14. In the event of printhead roll, the relative cross-process direction distances between pairs of inkjets in the printhead changes with alternating pairs of inkjets moving closer together and farther apart.

Figure 7B:
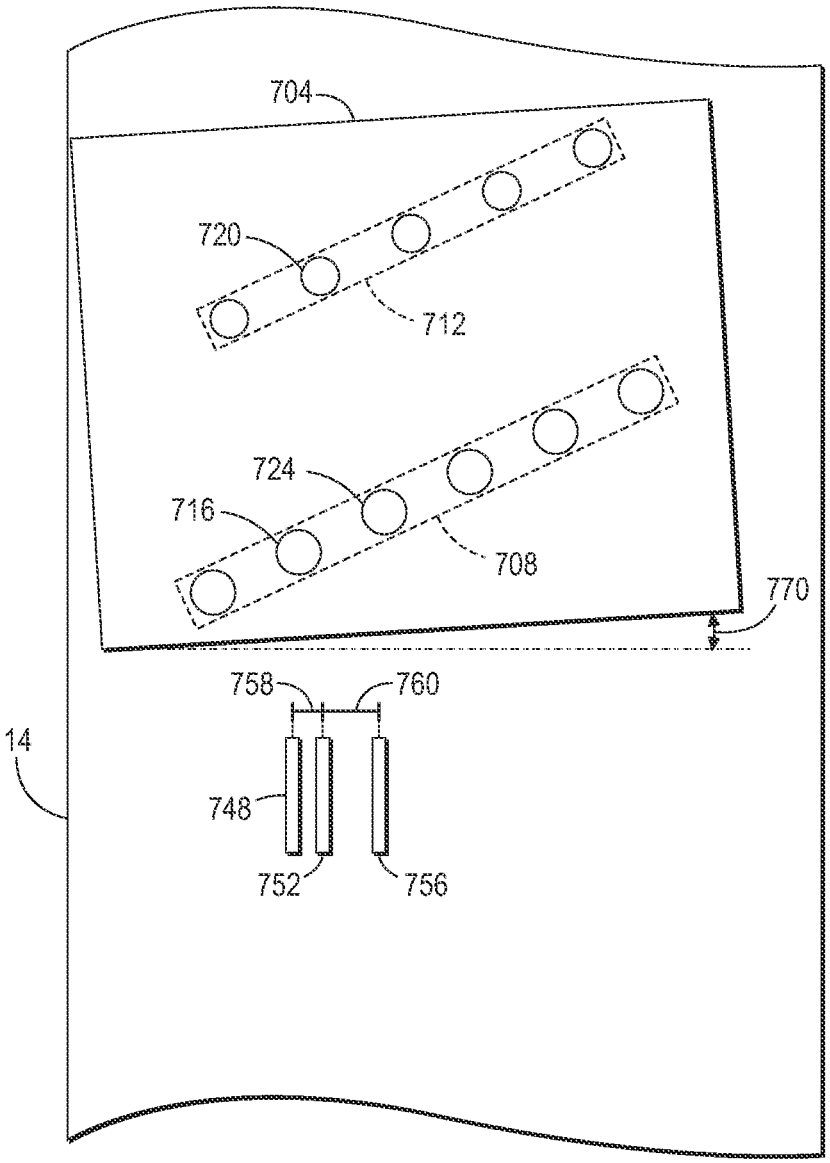
FIG. 7B is a diagram of the inkjet printhead of FIG. 7A with a counterclockwise printhead roll.

In FIG. 7A, the cross-process direction distance 730 between the marks 718 and 722 is the same as the cross-process direction distance 732 between the printed marks 722 and 726. The marks 718 and 722 correspond to the pair of inkjets 716 and 720, respectively, and the marks 722 and 726 correspond to the pair of inkjets 720 and 724, respectively. FIG. 7B depicts the printhead 704 with roll that is depicted by the angle 770. The roll includes both a magnitude component, and a direction, which is depicted as a counter-clockwise roll in FIG. 7B. In FIG. 7B, the roll in the printhead produces a change in the relative cross-process direction distances between the inkjets 716, 720, and 724. As depicted in FIG. 7, the printed marks 748, 752, and 756 are formed by the inkjets 716, 720, and 724, respectively. The marks 748 and 752 are separated by a cross-process direction distance 758 that is shorter than another cross-process direction distance 760 between the printed marks 752 and 756. Thus, when the printhead 704 rolls, the cross-process direction distances between the inkjets vary with alternating pairs of inkjets moving closer together and farther apart. In FIG. 7B, the inkjet pair 716 and 720 move closer together, while the inkjet pair 720 and 724 move farther apart in the cross-process direction.

Referring again to FIG. 6, process 600 continues with identification of the magnitude and direction of printhead roll with reference to the cross-process direction distance between the first first-row and second-row inkjet pair, the cross-process direction distance between the second-row inkjet and second first-row inkjet pair, the predetermined process direction distance between the first row and the second row of inkjets, and a predetermined resolution of the scanned image data that are used to identify the locations of the inkjets (block 612). In one embodiment, the printhead roll θ is identified using the following equation:

$$\theta = \arcsin\left((d_1 - d_2) * \frac{Res}{Y}\right),$$

where θ is the printhead roll expressed in radians, $d_1$ is the cross-process direction distance between the first pair of inkjets such as the distance 758 in FIG. 7B, $d_2$ is the cross-process direction distance between the second pair of inkjets such as the distance 760 in FIG. 7B, Res is a predetermined resolution of the scanned image data (e.g. 21 μm per pixel), and Y is the predetermined process direction distance between the first row of inkjets and the second row of inkjets, which is 11789 μm in one printhead embodiment. As depicted above, the magnitude of the printhead roll is affected by the difference between the inkjet pair distances $d_1$ and $d_2$. If the value of θ is a negative number (e.g. $d_1<d_2$), then the printhead roll is in the counterclockwise direction as depicted in FIG. 7B. If the value of θ is positive (e.g. $d_1>d_2$), then the printhead roll is in the clockwise direction.

During process 600, if the identified printhead roll θ is non-zero or exceeds a predetermined printhead roll tolerance threshold, then the controller 500 activates one or more actuators to correct the printhead roll and return the printhead to the configuration depicted in FIG. 7A (block 616). In another embodiment, the printer 5 generates an alert to identify the printhead roll and request manual correction of the printhead to reduce or eliminate the printhead roll.

As described above, the process 600 identifies a printhead roll using the identified cross-process direction locations of three inkjets in two different rows of the printhead. In some configurations, additional inkjets in the printhead form printed marks and the process 600 is applied to identify variations in the cross-process direction distances between multiple pairs of inkjets to improve the accuracy of identifying the printhead roll.

It will be appreciated that various of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A method for calibrating a printhead in a printer comprising:

operating a printhead with a controller to eject a plurality of ink drops from an inkjet in a printhead to form a plurality of marks on an image receiving surface of a print medium moving past the printhead in a process direction, each mark extending in the process direction on the image receiving surface;

generating with an optical sensor image data of a predetermined portion of the image receiving surface that includes the plurality of marks, the image data including a two-dimensional arrangement of pixels with a plurality of pixel rows extending in a cross-process direction and a plurality of pixel columns extending in the process direction;

identifying with the controller a plurality of amplitudes, each amplitude being identified for a portion of each pixel column in the image data of the predetermined portion of the image receiving surface, the portion of each pixel column including expected locations for a portion of the plurality of printed marks in the process direction;

identifying with the controller a pixel column corresponding to one of the plurality of identified amplitudes having an absolute value that is a local maximum within the image data for the predetermined portion of the image receiving surface;

identifying with the controller a cross-process direction location of the inkjet that ejected the ink drops in the identified pixel column with reference to the identified pixel column;

storing with the controller the identified cross-process direction location of the inkjet in a memory for use in printhead registration;

identifying with the controller a first sum of a plurality of products formed by multiplying the image data pixel values in the identified pixel column by a sine function corresponding to the printed pattern of marks in the pixel column;

identifying with the controller a second sum of a plurality of products formed by multiplying the image data pixel values in the identified pixel column multiplied by a cosine function corresponding to the printed pattern of marks in the pixel column;

identifying with the controller an offset with reference to an arc tangent of a ratio of the identified first sum divided by the identified second sum;

identifying with the controller an average location of the printed marks in the process direction with reference to the offset, a predetermined number of the printed marks, and a predetermined dimension in the process direction for each printed mark in the plurality of printed marks; and storing with the controller the average location of the printed marks in the memory for identification of a process direction location of printed ink drops ejected from the inkjet.

2. The method of claim 1 further comprising:

operating the printhead with the controller to eject a plurality of ink drops from another inkjet in the printhead to form another plurality of marks in the predetermined portion of the image receiving surface of the print medium to enable the generated image data of the predetermined portion of the image receiving surface to include image data of the other plurality of marks, each mark in the other plurality of marks extending in the process direction on the image receiving surface;

identifying with the controller another pixel column corresponding to one of the plurality of identified amplitudes having an absolute value that is another local maximum in the image data of the predetermined portion of the image receiving surface;

identifying with the controller a cross-process direction location of the other inkjet with reference to the other identified pixel column; and storing with the controller the identified cross-process direction location of the other inkjet in the memory for use in registering the printhead.

3. The method of claim 2 further comprising:

identifying with the controller an offset in the process direction for the other plurality of printed marks with reference to the image data corresponding to the identified pixel column for the other inkjet; and identifying with the controller an average location of the printed marks in the identified pixel column for the other inkjet in the process direction with reference to the offset identified for the other plurality of printed marks, the predetermined number of the printed marks in the other plurality of printed marks, and the predetermined dimension in the process direction for each printed mark in the other plurality of printed marks; and storing with the controller the average location of the other printed marks in the memory for identification of a process direction location of printed ink drops ejected from the other inkjet.

4. The method of claim 3 further comprising:

identifying with the controller a first distance in the process direction between the identified average location of the printed marks formed by the inkjet and the identified average location of the other printed marks formed by the other inkjet.

5. An inkjet printer comprising:

a printhead including a plurality of inkjets;

a media transport configured to move a print medium with an image receiving surface in a process direction past the printhead in a print zone;

an optical sensor configured to detect light reflected from the image receiving surface of the print medium after the print medium moves past the printhead; and a controller operatively connected to the printhead, media transport, optical sensor, and a memory, the controller being configured to:

operate the media transport to move the print medium in the process direction past the plurality of inkjets in the printhead;

operate the printhead to eject a plurality of ink drops from an inkjet in the printhead to form a plurality of marks on the image receiving surface of the print medium, each mark extending in a process direction on the image receiving surface;

generate with the optical sensor image data of a predetermined portion of the image receiving surface that includes the plurality of marks, the image data including a two-dimensional arrangement of pixels with a plurality of pixel rows extending in a cross-process direction and a plurality of pixel columns extending in the process direction;

identify a plurality of amplitudes, each amplitude being identified for a portion of each pixel column in the image data of the predetermined portion of the image receiving surface, the portion of each pixel column including expected locations for a portion of the plurality of printed marks in the process direction;

identify a pixel column corresponding to one of the plurality of identified amplitudes having an absolute value that is a local maximum within the image data for the predetermined portion of the image receiving surface;

identify a cross-process direction location of the inkjet that ejected the ink drops in the identified pixel column with reference to the identified pixel column;

store the identified cross-process direction location of the inkjet in the memory for use in printhead registration;

identify a first sum of a plurality of products formed by multiplication of the image data pixel values in the identified pixel column by a sine function corresponding to the printed pattern of marks in the pixel column;

identify a second sum of a plurality of products formed by multiplication of the image data pixel values in the identified pixel column multiplied by a cosine function corresponding to the printed pattern of marks in the pixel column;

identify an offset with reference to an arc tangent of a ratio of the identified first sum divided by the identified second sum;

identify an average location of the printed marks in the process direction with reference to the offset, a predetermined number of the printed marks, and a predetermined dimension in the process direction for each printed mark in the plurality of printed marks; and store the average location of the printed marks in the memory for identification of a process direction location of printed ink drops ejected from the inkjet.

6. The inkjet printer of claim 5, the controller being further configured to:

operate the printhead to eject a plurality of ink drops from another inkjet in the printhead to form another plurality of marks in the predetermined portion of the image receiving surface of the print medium to enable the generated image data of the predetermine portion of the image receiving surface to include image data of the other plurality of marks, each mark in the other plurality of marks extending in a process direction on the image receiving surface;

identify another pixel column corresponding to one of the plurality of identified amplitudes having an absolute value that is another local maximum in the image data of the predetermined portion of the image receiving surface;

identify a cross-process direction location of the other inkjet with reference to the other identified pixel column; and store the identified cross-process direction location of the other inkjet in the memory for use in registering the printhead.

7. The inkjet printer of claim 6, the controller being further configured to:

identify an offset in the process direction for the other plurality of printed marks with reference to the image data corresponding to the identified pixel column for the other inkjet; and identify an average location of the printed marks in the identified pixel column for the other inkjet in the process direction with reference to the offset identified for the other plurality of printed marks, the predetermined number of the printed marks in the other plurality of printed marks, and the predetermined dimension in the process direction for each printed mark in the other plurality of printed marks; and store the average location of the other printed marks in the memory for identification of a process direction location of printed ink drops ejected from the other inkjet.

* * * * *